US011821715B2

(12) United States Patent
Huecking

(10) Patent No.: US 11,821,715 B2
(45) Date of Patent: Nov. 21, 2023

(54) UNDERWATER VEHICLE COMPRISING TWO SHAPED CHARGES ARRANGED BEHIND ONE ANOTHER

(71) Applicants: ATLAS ELEKTRONIK GMBH, Bremen (DE); thyssenkrupp AG, Essen (DE)

(72) Inventor: Christian Huecking, Achim (DE)

(73) Assignees: ATLAS ELEKTRONIK GMBH, Bremen (DE); thyssenkrupp AG, Essen (DE)

( * ) Notice: Subject to any disclaimer, the term of this patent is extended or adjusted under 35 U.S.C. 154(b) by 120 days.

(21) Appl. No.: 17/642,386

(22) PCT Filed: Sep. 4, 2020

(86) PCT No.: PCT/EP2020/074733
§ 371 (c)(1),
(2) Date: Mar. 11, 2022

(87) PCT Pub. No.: WO2021/048012
PCT Pub. Date: Mar. 18, 2021

(65) Prior Publication Data

US 2022/0325994 A1 Oct. 13, 2022

(30) Foreign Application Priority Data

Sep. 12, 2019 (DE) ..... 10 2019 213 944.2

(51) Int. Cl.
*F42B 12/18* (2006.01)
*F42B 19/00* (2006.01)

(52) U.S. Cl.
CPC ..... *F42B 12/18* (2013.01); *F42B 19/00* (2013.01)

(58) Field of Classification Search
None
See application file for complete search history.

(56) References Cited

U.S. PATENT DOCUMENTS 5,415,105 A 5/1995 Voss et al.
5,621,185 A 4/1997 Spengler et al.

FOREIGN PATENT DOCUMENTS

DE 24 60 303 A1 10/1978
DE 30 10 917 A1 10/1981
(Continued)

OTHER PUBLICATIONS

English Translation of International Search Report issued in PCT/EP2020/074733, dated Feb. 5, 2021.

*Primary Examiner* — Reginald S Tillman, Jr.
(74) *Attorney, Agent, or Firm* — thyssenkrupp North America, LLC

(57) ABSTRACT

A watercraft may include a first shaped charge as well as a second shaped charge. The second shaped charge may be positioned behind the first shaped charge in an effective direction of the first shaped charge. The effective direction of the first shaped charge and an effective direction of the second shaped charge may run to a common target point. At least one of the first shaped charge or the second shaped charge is movable. Further, a distance sensor may be configured to detect a distance between the watercraft and an object positioned in front of the watercraft. An electronic evaluation and control system can process the distance that is detected by the distance sensor and move at least one of the first shaped charge or the second shaped charge based on the distance that is detected.

8 Claims, 1 Drawing Sheet

(56) References Cited

FOREIGN PATENT DOCUMENTS

| | | | | |
|---|---|---|---|---|
| DE | 35 40 021 | A1 | 5/1987 | |
| DE | 36 05 579 | C1 | 5/1987 | |
| DE | 42 40 084 | A1 | 6/1994 | |
| DE | 36 33 535 | C1 | 9/1996 | |
| EP | 1087203 | B1 * | 5/2006 | ..... F42B 12/18 |
| FR | 2 779 514 | A1 | 12/1999 | |

* cited by examiner

UNDERWATER VEHICLE COMPRISING TWO SHAPED CHARGES ARRANGED BEHIND ONE ANOTHER

CROSS REFERENCE TO RELATED APPLICATIONS

This application is a U.S. National Stage Entry of International Patent Application Serial Number PCT/EP2020/074733, filed Sep. 4, 2020, which claims priority to German Patent Application No. DE 10 2019 213 944.2, filed Sep. 12, 2019, the entire contents of both of which are incorporated herein by reference.

FIELD

The present disclosure generally relates to watercraft having a shaped charge and watercraft that are routinely deployed in clearing objects such as mines.

BACKGROUND

Clearing a mine normally involves the explosive present within the mine being detonated from outside by a charge. A shaped charge is normally used for this purpose. However, the important thing in this case is that the explosive used in a mine may itself be hard to ignite and only the actual fuze contains highly explosive material. It is therefore necessary for a high energy input into the mine's explosive to be achieved in a volume. For this reason, shaped charges are customarily used in order to detonate the explosive in a mine.

In a maritime environment, the arrangements in the three-dimensional space and also within the element region, and other bodies present within the environment, mean that it is not possible to approach the mine freely in every case. As a result of this, the distance between the mine and the watercraft used for mine clearance is deployment-dependent. This gives rise to the problem that an optimal introduction of energy into the explosive in the mine is not possible in every case, because water and other barrier layers such as the casing of the mine, for example, have an attenuating effect on the action of the shaped charge.

When clearing a mine it is essential to know whether the object that is to be exploded has been safely disarmed. The quickest and most reliable way of ensuring this is for the mine to be exploded during clearance. The parameters during clearance should therefore be such that the explosive which is present is detonated safely and reliably.

In addition, it may be that the mine is not only protected by a casing. For example, after the Second World War large quantities of munitions were dumped in the North Sea and the Baltic Sea. Some of these are in containers such as boxes, crates or cages. There are also mines which comprise a second casing and a layer of water between the casings. In these cases, the plasma beam is attenuated by the layer of water between the first obstacle and the second casing.

A combined projectile having a plurality of shaped charges arranged on the longitudinal axis of the projectile for engaging underwater vehicles is known from DE 24 60 303 A1.

A projectile comprising a main charge and an additional charge is known from DE 35 40 021 A1.

A warhead having a main shaped charge and at least one shaped precharge is known from DE 30 10 917 A1.

A tandem warhead having a main charge and a precharge is known from DE 42 40 084 A1.

A missile having a tiltable hollow charge is known from DE 36 05 579 C1.

Thus, a need exists for a watercraft with which a mine can be safely cleared, whereof the casing which surrounds the explosive is not directly accessible.

DETAILED DESCRIPTION

Figure 1:
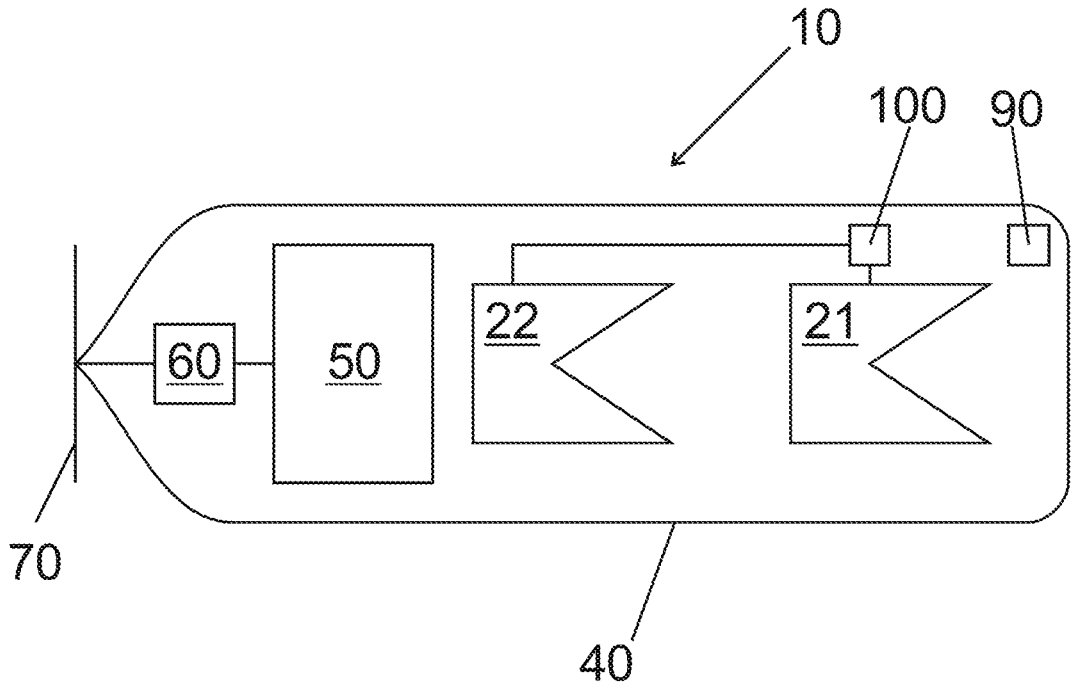
FIG. 1 is a schematic view of an example watercraft.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The watercraft according to the invention having a first shaped charge comprises a second shaped charge, which is arranged behind the first shaped charge in the effective direction of the first shaped charge, wherein the effective direction of the first shaped charge and the effective direction of the second shaped charge run to a common target point. The effective direction of the first shaped charge and the effective direction of the second shaped charge preferably run along a common line towards the target, and are therefore coaxial.

The aim and effect of this arrangement is that the first shaped charge is ignited to begin with. In the coaxial arrangement, the first shaped charge is arranged in front of the second shaped charge. This produces a plasma lance which causes the water arranged between the watercraft and a mine to be evaporated. Where necessary, this first plasma lance of the first shaped charge penetrates a first obstacle, for example a first wall of a double-walled mine, a munitions crate, or the like. Very shortly afterwards, before the bubble resulting from the evaporation collapses once again, the second shaped charge is ignited. The second plasma lance resulting from the ignition of the second shaped charge is now able to reach the mine with substantially less attenuation. In this way, the second shaped charge, in particular, may be designed and/or arranged in such a manner that the second plasma lance is particularly narrow and particularly quick as a result. This second plasma lance would be subject to particularly strong attenuation underwater where a relatively long distance was involved, but this is prevented by the first plasma lance. Consequently, the energy introduced into the mine can be maximized and a successful clearance thereby guaranteed.

At least one of the two shaped charges is arranged to be movable. The first shaped charge and the second shaped charge are preferably arranged to be movable, wherein the distance between the first shaped charge and the second shaped charge is constant. The movability means that adjustment to a variable distance between the watercraft and mine is made possible. In addition, the distance selected between the first shaped charge and the second shaped charge is so great that the second plasma lance is thereby focused and is as narrow as possible. There would therefore no longer be any benefit in increasing the distance. Reducing it would cause the focusing to abate and the energy input into the mine is therefore weakened as the case may be.

The watercraft also has a distance sensor and an electronic evaluation and control system. The distance sensor is designed to detect the distance between the watercraft and an object arranged in front of the watercraft. This distance must be covered by the plasma lance. It must therefore be possible for this distance to be determined, so that the shaped charges can be adapted accordingly, in order to achieve an optimal effect. The electronic evaluation and control system is designed to process the distance detected by the distance sensor between the watercraft and the object arranged in front of the watercraft. The electronic evaluation and control system is also designed to move at least one of the two shaped charges, depending on the distance detected. The movement of at least one of the two shaped charges by the electronic evaluation and control system preferably takes place with the help of a motor, which is controlled by the electronic evaluation and control system and moves at least one of the two shaped charges, preferably both shaped charges together.

In this way, it is possible for the shape of the plasma lance produced by the first shaped charge to be adapted to the distance. The distance underwater can often not be arbitrarily set to a predetermined value, due to obstacles or currents, for example, which means that it has proved advantageous for the actual distance to be determined and then the position of at least one of the two shaped charges adapted to the distance.

In a further embodiment of the invention, the effective direction of the first shaped charge and the effective direction of the second shaped charge run in parallel. In particular, the effective direction of the first shaped charge and the effective direction of the second shaped charge are arranged in the longitudinal direction of the watercraft. In this way, a slender design is made possible.

In a further embodiment of the invention, a first gas chamber is arranged between the first shaped charge and the casing of the watercraft, and a second gas chamber between the first shaped charge and the second shaped charge. The length of the first gas chamber in the effective direction of the first shaped charges is smaller than the length of the second gas chamber in the effective direction of the second shaped charge. This means that the second plasma lance produced by the second shaped charge is more focused. A larger bubble of evaporated water is therefore created by the wider first plasma lance, so that the second plasma lance is not attenuated.

In an alternative embodiment of the invention, the effective direction of the first shaped charge and the effective direction of the second shaped charge are not arranged in parallel to one another. In this case, the first gas chamber, which is arranged in front of the first shaped charge in the effective direction, must be selected to be so short that the resulting plasma lance is wide enough for the effective direction of the second shaped charge to be within the opening angle of the plasma lance of the first shaped charge. Advantages of this embodiment are, on the one hand, that the second shaped charge need not penetrate the rear wall of the first shaped charge and is not therefore attenuated, and, on the other hand, a shorter design can be realized. The disadvantage, however, is that the first shaped charge produces a comparatively wide plasma lance and therefore has to evaporate a comparatively greater amount of water. In the case of a double-walled mine, penetration can also be made more difficult.

In a further embodiment of the invention, the first shaped charge has a first fuze and the second shaped charge has a second fuze. The first fuze and the second fuze are connected to an ignition device. The ignition device has a delay device, wherein the delay device brings about a later ignition of the second fuze. The delay device is also regarded as an integral part of the ignition device, when the delay device is an integral part of the connection between the central core of the ignition device and the second fuze. For example, the connection between the central core of the ignition device and the second fuze may be longer than the connection between the central core of the ignition device and the first fuze.

In a further embodiment of the invention, the first gas chamber arranged in front of the first shaped charge in the effective direction of the first shaped charge is shorter than the second gas chamber arranged in front of the second shaped charge in the effective direction of the second shaped charge. It is thereby achieved that the plasma lance of the first shaped charge is less focused than the plasma lance of the second shaped charge.

In FIG. 1 the watercraft 10 is shown as a schematic cross section. The watercraft 10 has a battery 50, a motor 60, and a propeller 70 for propulsion. Alternatively, the watercraft 10 may also comprise multiple motors 60 and propellers 70. A first shaped charge 21 and a second shaped charge 22, which are aligned with the effective direction in the longitudinal direction of the watercraft and in the travelling direction of the watercraft 10, are arranged in the watercraft 10. It can be seen that the first gas chamber lying between the first shaped charge 21 and the casing 40 is shorter than the second gas chamber, which is arranged between the second shaped charge 22 and the first shaped charge 21. In this way, the second plasma beam of the second plasma charge 22 is more focused. The watercraft 10 has an ignition device 100, in order to ignite the first shaped charge 21 and the second shaped charge 22. In the example shown, the ignition device 100 is arranged in such a manner that the central core of the ignition device 100 has a longer connection to the second shaped charge 22 than the connection to the first shaped charge 21, so that the connection from the central core of the ignition device to the second shaped charge 22 acts as a delaying device. In addition, the watercraft 10 comprises sonar 90, in order to determine the distance of the watercraft 10 from a mine.

Figure 2:
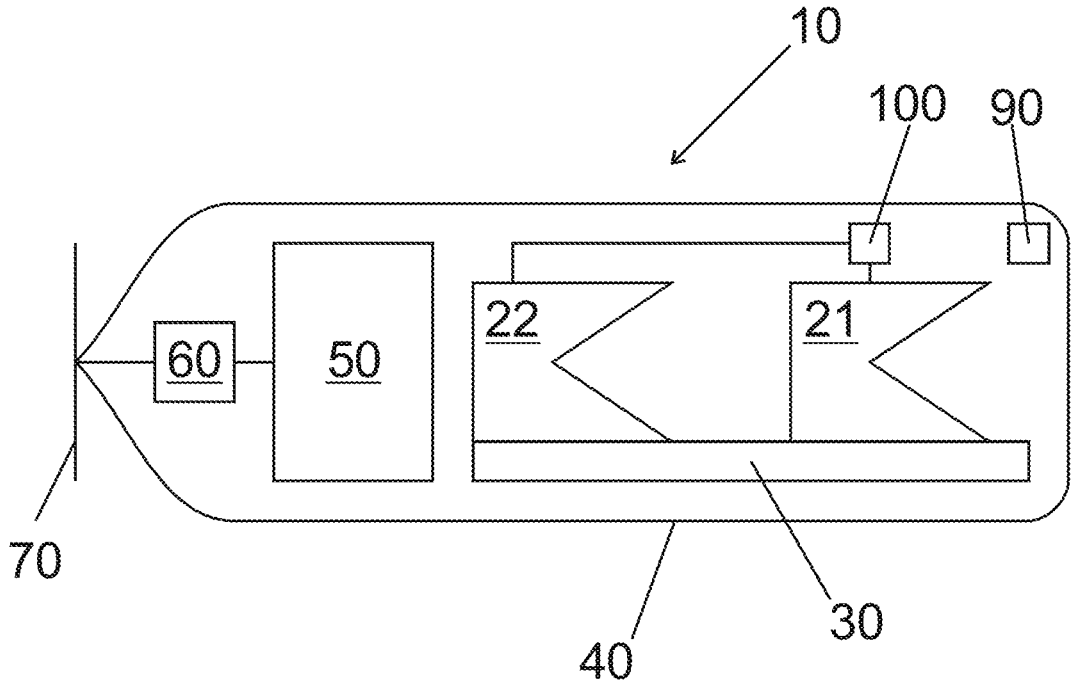
FIG. 2 is a schematic view of an example watercraft having movable shaped charges.

In addition, the watercraft 10 shown in FIG. 2 comprises a threaded rod 30, with which the first shaped charge 21 and the second shaped charge 22 can be jointly displaced. In this way, the widening of the plasma beam of the first shaped charge 21 can be changed. On the other hand, due to the constant distance between the first shaped charge 21 and the second shaped charge 22, the shape of the second plasma beam remains unchanged.

REFERENCE SIGNS

10 watercraft
21 first shaped charge
22 second shaped charge
30 threaded rod
40 casing

50 battery
60 motor
70 propeller
90 sonar
100 ignition device

What is claimed is:

1. A watercraft comprising:

a first shaped charge;

a second shaped charge disposed behind the first shaped charge in an effective direction of the first shaped charge, wherein the effective direction of the first shaped charge and an effective direction of the second shaped charge extend to a common target point, wherein at least one of the first shaped charge or the second shaped charge is movable;

a distance sensor configured to detect a distance between the watercraft and an object positioned in front of the watercraft; and an electronic evaluation and control system configured to process the distance that is detected by the distance sensor, wherein the electronic evaluation and control system is configured to move at least one of the first shaped charge or the second shaped charge based on the distance that is detected.

2. The watercraft of claim 1 wherein the effective direction of the first shaped charge and the effective direction of the second shaped charge are parallel.

3. The watercraft of claim 1 wherein a main extent of the watercraft extends in a longitudinal direction, wherein the effective direction of the first shaped charge and the effective direction of the second shaped charge are arranged in the longitudinal direction of the watercraft.

4. The watercraft of claim 1 wherein the first shaped charge and the second shaped charge are movable, wherein a distance between the first shaped charge and the second shaped charge is constant.

5. The watercraft of claim 1 wherein the first shaped charge includes a first fuse, wherein the second shaped charge includes a second fuse, wherein the first fuse and the second fuse are connected to an ignition device, wherein the ignition device includes a delay device configured to cause a delayed ignition of the second fuse.

6. The watercraft of claim 1 comprising:

a first gas chamber disposed between the first shaped charge and a casing of the watercraft; and a second gas chamber disposed between the first shaped charge and the second shaped charge, wherein a length of the first gas chamber in the effective direction of the first shaped charge is smaller than a length of the second gas chamber in the effective direction of the second shaped charge.

7. The watercraft of claim 6 wherein the first gas chamber positioned in front of the first shaped charge in the effective direction of the first shaped charge is shorter than the second gas chamber positioned in front of the second shaped charge in the effective direction of the second shaped charge.

8. The watercraft of claim 1 wherein the distance sensor is sonar.

* * * * *